US006027266A

United States Patent [19]

Turner

[11] Patent Number: 6,027,266

[45] Date of Patent: Feb. 22, 2000

[54] IMPACT PRINTER CASSETTE HAVING NOISE REDUCTION PADS

[75] Inventor: Kyle Turner, Ithaca, N.Y.

[73] Assignee: Axiohm Transaction Solutions, Inc., Blue Bell, Pa.

[21] Appl. No.: 09/130,699

[22] Filed: Aug. 7, 1998

[51] Int. Cl.[7] ..... B41J 35/28

[52] U.S. Cl. ..... 400/208

[58] Field of Search ..... 400/208, 689

[56] References Cited

U.S. PATENT DOCUMENTS 4,383,775 5/1983 Trammell et al. ..... 400/208

5,211,492 5/1993 Hirano ..... 400/645

*Primary Examiner*—Ren Yan
*Assistant Examiner*—Amanda B. Sandusky
*Attorney, Agent, or Firm*—Salzman & Levy

[57] ABSTRACT

An improved ribbon cassette is provided for a receipt printer of the impact printing type. The ribbon cassette has two raised areas disposed on the distal ends of the ribbon presenting arms, about the print area defining the ribbon window. These raised areas act as pressure bumps or spring-like retaining pads that bias the paper against the platen. In accomplishing the bias, a paper bubble commonly formed in the ribbon window area is substantially reduced or eliminated. This has the effect of reducing the noise generated by the impact wires of the print head striking the paper.

2 Claims, 2 Drawing Sheets

IMPACT PRINTER CASSETTE HAVING NOISE REDUCTION PADS

FIELD OF THE INVENTION

The present invention relates to an impact printing apparatus and, more particularly, to a ribbon cassette for an impact printer that substantially reduces the noise generated by the print head.

BACKGROUND OF THE INVENTION

In impact printers, such as the Model No. 7221 impact printer manufactured by the present assignee of this invention, the printer can produce an objectionable level of noise. The printer generates a 1,200 Hz sound wave that, at elevated decibel levels, becomes annoying to the human ear. The sound wave is due in part to the wires of the impact print head, which slap at the paper in a small, concentrated, bubbled area. This bubbled area comprises a small air space that inherently forms between the receipt paper and the platen in receipt printing apparatus of this type.

It has been discovered by the present inventor that the noise generated in this bubble area can be greatly reduced by redesigning the ribbon cassette. This inventor has found that by keeping pressure on the receipt paper as it feeds over the platen, the bubble is substantially reduced or eliminated. This in turn reduces the noise during operation.

Two prongs have been added to the front of the cassette, about the ribbon window. These prongs straddle the striking area of the print head, and provide biasing against the paper bubble. The prongs act as spring retainers or pressure bumps that apply pressure to the paper as it passes before the impacting wires of the print head.

DISCUSSION OF RELATED ART

In U.S. Pat. No. 5,211,492 issued to Hirano, on May 18, 1993, for a SERIAL IMPACT PRINTER, an impact printer is illustrated that has sheet retaining rollers to reduce noise. The impact printer has a carriage with guide posts that protrude into the paper path above the platen and bend the paper, thereby reducing the free length of paper that can vibrate. The apparatus of the invention, however, is concerned with a different area of the paper, viz., the area directly in front of the platen that is impacted by the print head wires.

SUMMARY OF THE INVENTION

In accordance with the present invention, there is provided an improved ribbon cassette for a receipt printer of the impact printing type. The ribbon cassette comprises two raised areas disposed on the distal ends of the ribbon presenting arms, about the print area defining the ribbon window. These raised areas act as pressure bumps or spring-like retaining pads that bias the paper against the platen. In accomplishing the bias, a paper bubble commonly formed in the ribbon window area is substantially reduced or eliminated. This has the effect of reducing the noise generated by the impact wires of the print head striking the paper.

It is an object of the present invention to provide an improved ribbon cassette for an impact receipt printer.

It is another object of this invention to provide a ribbon cassette for an impact receipt printer that substantially reduces or eliminates the noise generated by the impact wires of the print head upon the paper and platen.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

Generally speaking, the invention features a ribbon cassette for an impact receipt printer that provides quieter operation. The ribbon cassette comprises a pair of ribbon presenting arms that have raised areas on their distal ends. These raised areas press against the paper in the ribbon window, thus substantially reducing or eliminating a paper bubble that forms in the impact printing area. Reduction of the bubble reduces or eliminates the noise associated with the impact wires of the print head as they contact the paper.

Figure 1:
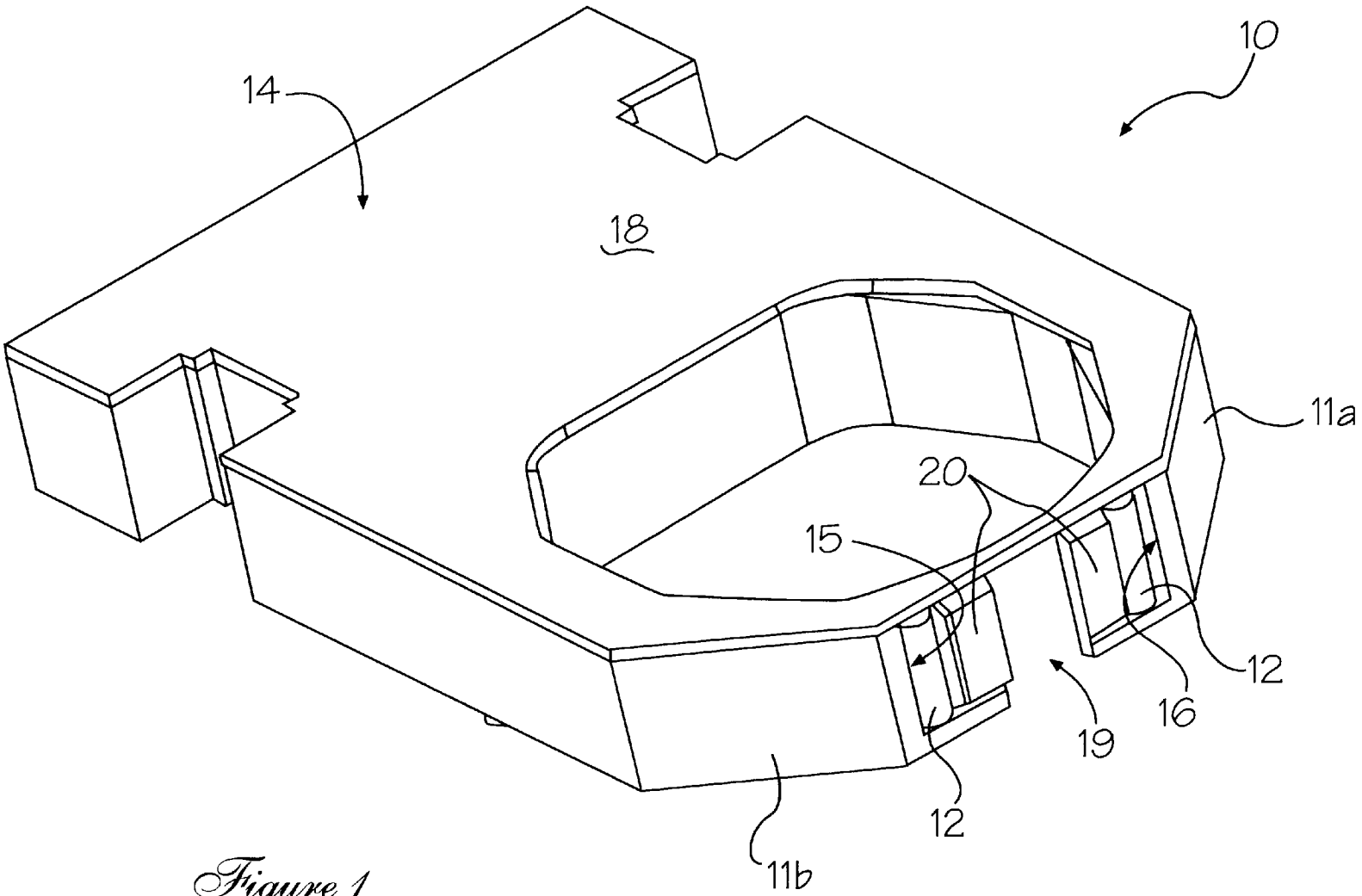
FIG. 1 illustrates a perspective view of a typical ribbon cassette used in an impact receipt printer, the cassette being modified with the addition of two prongs or pads disposed upon the distal end of the ribbon arms, in accordance with this invention.
Figure 2:
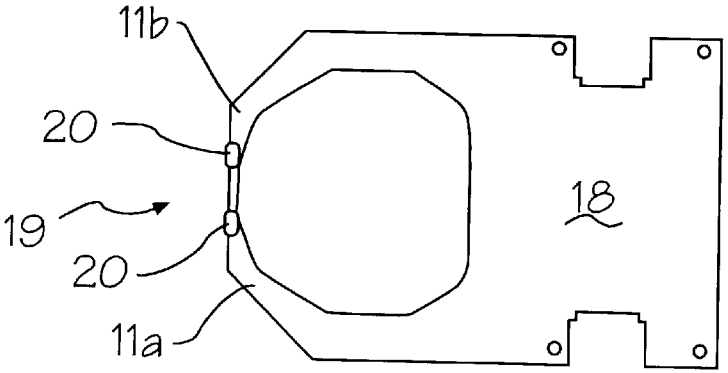
FIG. 2 depicts a plan view of the top portion of the ribbon cassette shown in FIG. 1.

Now referring to FIGS. 1 and 2, a typical ribbon cassette 10 for an impact receipt printer, such as a Model No. 7221, manufactured by the present assignee, is illustrated in a modified condition befitting this invention. The cassette 10 typically comprises two presenting arms 11*a* and 11*b*, respectively, as shown. The ribbon (not shown) of the cassette 10 is internally wound in the storage area 14 of cassette 10, and emerges from a slot 15 in the presenter arm 11*b*. The ribbon re-enters the cassette housing 18 through slot 16 in presenter arm 11*a*, as is well known in the art. The ribbon stretches across the print window 19 spanning the two presenter arms 11*a* and 11*b*. The ribbon is supported upon two roller stanchions 12, as it is stretched across the print window 19.

A raised pad 20 is placed upon each presenter arm 11*a* and 11*b*, respectively. These raised pads 20 act as pressure bumps, or spring-like retaining areas, that bias the receipt paper (not shown) against the printing platen (not shown). In accomplishing the bias, a paper bubble (not shown), commonly formed in the ribbon window area, is substantially reduced or eliminated. This has the effect of reducing the noise generated by the impact wires of the print head striking the paper bubble.

Figure 3:
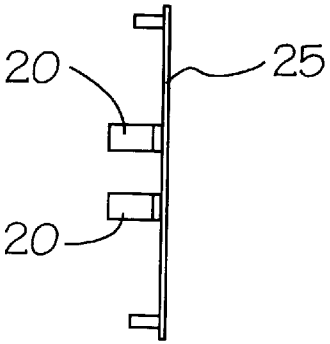
FIG. 3 shows a front view of a retaining piece that can be added to a typical ribbon cassette to increase the thickness at the distal ends of the ribbon arms, about the impact print window.
Figure 4:
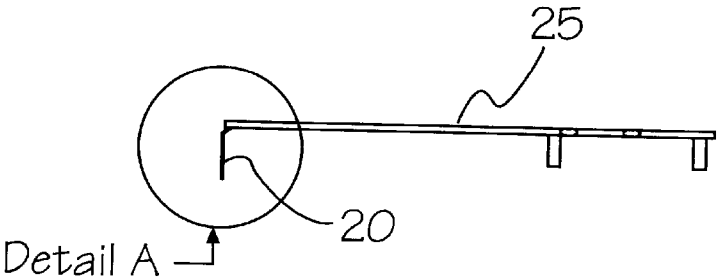
FIG. 4 illustrates a side view of the retaining piece shown in FIG. 3.

Referring to FIGS. 3 and 4, a retainer element 25 for attaching pads 20 to the body of the cassette 10 (FIG. 1) is illustrated. It should be obvious to those skilled in the art that pads 20 could be retrofitted to other cassettes by suitable modifications to retaining element 25.

Figure 5:
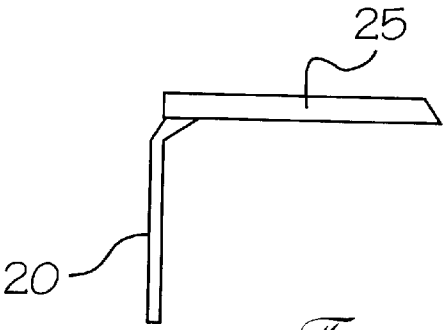
FIG. 5 shows an enlarged side view of a front portion detail depicted in FIG. 4.

Referring to FIG. 5, the raised pad 20 is shown enlarged from the area of detail A, shown in FIG. 4. Naturally, the raised pad 20 can be made an original part of the cassette 10, as well as being retro-fitted thereto, as shown here. A typical height of the pad 20 is about 0.365 inches, and a typical width is about 0.165 inches. A typical thickness can be in the range of between 0.020 and 0.030 inches.

In tests run in the laboratory, a typical pair of raised pads 20 has been shown to reduce the noise level by about 4 dB.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

The present invention is particularly directed to use in a transaction printer which will employ varying features and functions, described in differing aspects, in any one or more of the following group of copending patent applications, all filed concurrently on Aug. 7, 1998: AXI-126 to Martinez et al for "COMPACT RIBBON CASSETTE", U.S. Ser. No. 09/130,598; AXI-140 to Martinez for "RIBBON CASSETTE HAVING END OF RIBBON SENSING", U.S. Ser. No. 09/130,716; AXI-141 to Rowlands for "POINT-OF-SALE MICR PRINTING AND READING", U.S. Ser. No. 09/130,811; AXI-145 to Martinez et al for "COMPACT RIBBON CASSETTE WITH INTEGRAL FRICTION PLATE", U.S. Ser. No. 09/131,189; AXI-146 to Martinez et al for "COMPACT RIBBON CASSETTE WITH MESHING GEAR POSITIVE DRIVE", U.S. Ser. No. 09/130,715; AXI-147 to Martinez et al for "THERMAL TRANSFER MICR PRINTER", U.S. Ser. No. 09/131,110; AXI-148 to Martinez et al for "THERMAL TRANSFER MICR PRINTER", U.S. Ser. No. 09/131,112; AXI-149 to Walls et al for "CHECK PROCESSING", U.S. Ser. No. 09/131,111; and AXI-150 to Martinez et al for "CHECK PROCESSING MICR PRINTER AND ENCODER", U.S. Ser. No. 09/130,700.

What is claimed is:

1. A ribbon cassette for a receipt printer of the impact printing type having noise reduction, comprising: a housing, a printing ribbon stored in said housing, said housing having two arms extending therefrom, said arms supporting said ribbon across a span defining a print window, a raised area respectively disposed on each distal end of the arms and disposed about a print area defined by said print window, each of said raised areas acting as pressure bumps pressing said ribbon into contact with receipt paper in order to bias said receipt paper against a printing platen, and reducing noise generated by impacting elements impinging upon said ribbon.

2. A ribbon cassette for a receipt printer of the impact printing type having noise reduction, comprising: a housing, a printing ribbon stored in said housing, said housing having two arms extending therefrom, said arms supporting said ribbon across a span defining a print window, a retainer fitted to said housing for adding raised areas on each distal end of said arms, said raised areas being fitted about a print area defined by said print window, each of said raised areas acting as pressure bumps pressing said ribbon into contact with receipt paper in order to bias said receipt paper against a printing platen, and reducing noise generated by impacting elements impinging upon said ribbon.

* * * * *